United States Patent [19]

Förster et al.

[11] Patent Number: 4,509,488

[45] Date of Patent: Apr. 9, 1985

[54] PROCESS AND APPARATUS FOR INTERMITTENT CONTROL OF A CYCLICALLY OPERATING INTERNAL COMBUSTION ENGINE

[75] Inventors: Hans-Joachim Förster, Stuttgart; Bernd-Eric Lübbing, Winterbach; Ulrich Letsche, Stuttgart, all of Fed. Rep. of Germany

[73] Assignee: Daimler-Benz Aktiengesellschaft, Fed. Rep. of Germany

[21] Appl. No.: 397,045

[22] Filed: Jul. 12, 1982

[30] Foreign Application Priority Data

Jul. 23, 1981 [DE] Fed. Rep. of Germany ..... 3129078

[51] Int. Cl.[3] ..... F02D 73/06

[52] U.S. Cl. ..... 123/481; 123/198 F

[58] Field of Search ..... 123/481, 198 F

[56] References Cited

U.S. PATENT DOCUMENTS

| | | | |
|---|---|---|---|
| 2,771,867 | 11/1956 | Peras | 123/481 |
| 4,040,395 | 8/1977 | Demetrescu | 123/198 F |
| 4,103,655 | 8/1978 | Coles . | |
| 4,146,006 | 3/1979 | Garabedian . | |
| 4,153,033 | 5/1979 | Iizuka | 123/481 |
| 4,227,505 | 10/1980 | Larson et al. | 123/198 F |
| 4,328,546 | 5/1982 | Kreft et al. . | |
| 4,391,255 | 7/1983 | Staerzl | 123/481 |

*Primary Examiner*—Ronald B. Cox

*Attorney, Agent, or Firm*—Craig & Burns

[57] ABSTRACT

A process for intermittent control of a cyclically operating internal combustion engine wherein, in the succession of working cycles, working strokes are skipped—in approximately uniform distribution—and the number of skips is varied in dependence on the load. Fuel is fed in a controlled fashion only to the nonskipping working chambers of the internal combustion engine independently of the load in a constant quantity optimal for consumption. For a sensitive power distribution, especially in the low load range, the number of skips is varied chronologically at least approximately randomly and independently of the speed, i.e., the temporal density of the working strokes is varied. This can be accomplished by setting differently finely staggered firing patterns or by a stochastic ignition setting.

4 Claims, 8 Drawing Figures

FIG. 1

| AVERAGE NUMBER OF FIRED CYLINDERS PER 720° CRANK ANGLE | SCHEME OF FIRED CYLINDERS | | |

FIG. 7
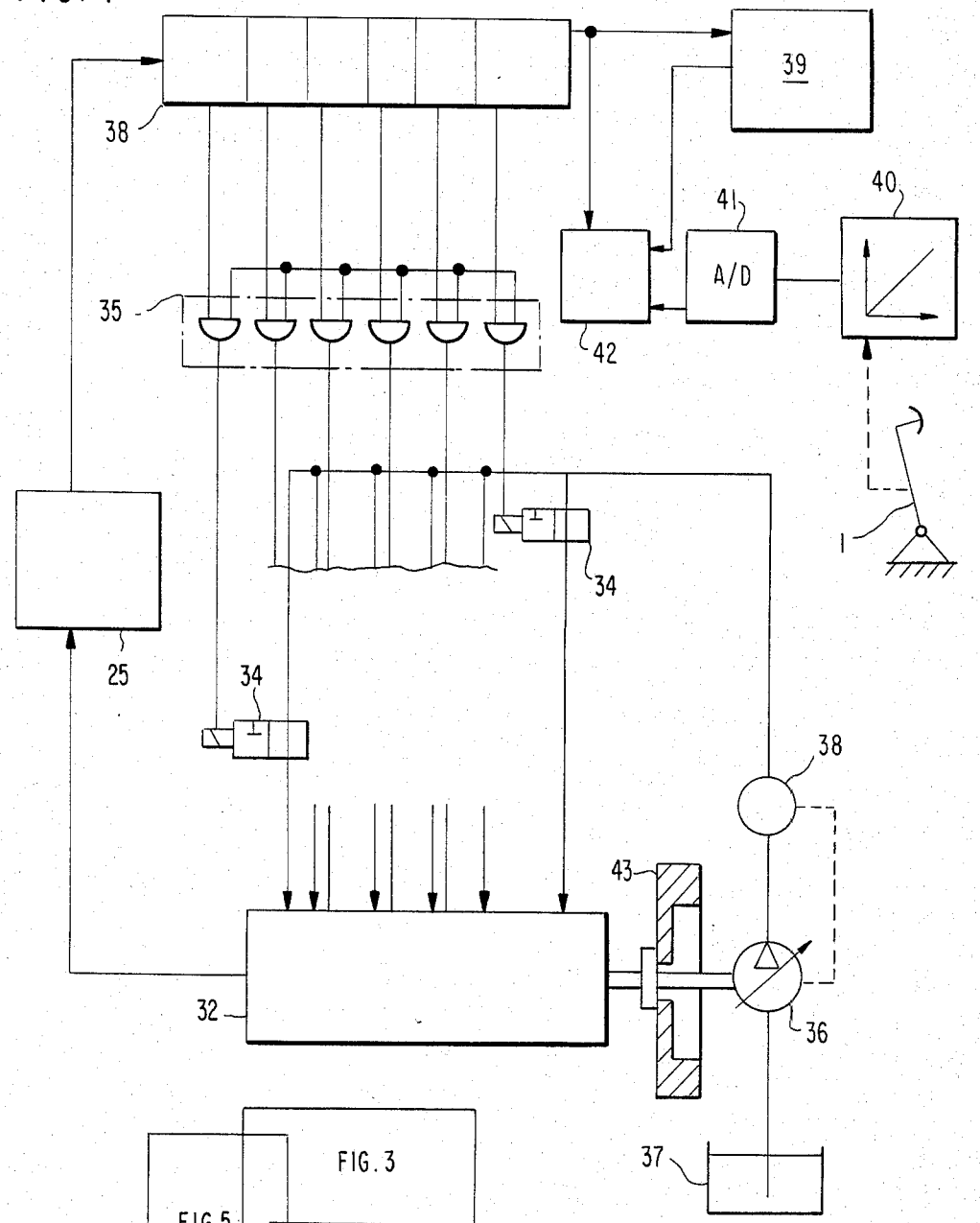
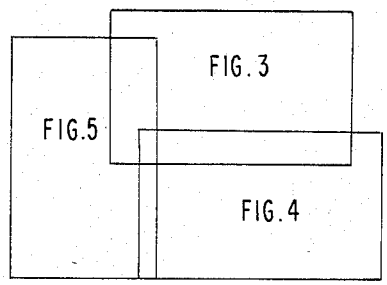
FIG. 6

PROCESS AND APPARATUS FOR INTERMITTENT CONTROL OF A CYCLICALLY OPERATING INTERNAL COMBUSTION ENGINE

The invention relates to a process for intermittent control of a cyclically operating internal combustion engine and apparatus for carrying the process wherein, during operation of the internal combustion engine, working strokes are skipped in the succession of working cycles in approximately uniform distribution and the number of skips is varied in dependence on the load, wherein, in a controlled fashion, fuel is fed only respectively to the nonskipping working chambers of the internal combustion engine, namely independently of the load, in a constant amount per working stroke, as disclosed, for example, in German Published Application 1,105,233.

In the conventional process for intermittent control, engines of a large number of cylinders form the basis for the procedure; the number of skips is varied in a staggered fashion dependent on the load within a specific number of revolutions. For this purpose, a control drum is provided which, for reasons of effecting a correct phase correlation of the instant of ignition and/or the instant of injection with the corresponding working stroke, revolves at a number of revolutions which has a constant relation to the engine speed.

The advantageous feature of intermittent control is that the operating cylinders can work, over a large operating range, in each case at their optimum point, and therefore an especially high degree of efficiency, i.e., low fuel consumption, can be attained. However, one disadvantage of the conventional method resides in that this process must be based on engines with a very large number of cylinders, yet the stepwise jumps in the low-power ranges are very large.

For example, if the process is based on an eight-cylinder engine, the latter can run, in the lowest stage, merely on a single cylinder. The next-higher power stage would be immediately increased by one-hundred percent, i.e., engine operation on only two cylinders. The next-higher power setting possible would be increased by fifty percent as compared with this power stage, namely operation on three cylinders. The higher the setting for the required power, the smaller are the relative stepwise jumps. However, the practical requirements are oriented precisely in the opposite direction, namely, in the range of low power, the power must be adjustable with sensitivity; in the high-power range, relatively large stepwise jumps are more readily permissible.

It is an object of the invention to design the process in such a manner that the power can be adjusted with sensitivity even in the low-power range.

This object has been attained according to the invention by a process for intermittent control of a cyclically operating internal combustion engine wherein, during operation of the internal combustion engine, working strokes are skipped in the succession of working cycles in approximately uniform distribution and the number of skips is varied in dependence on the load, and wherein, in a controlled fashion, fuel is fed only respectively to the nonskipping working chambers of the internal combustion engine independently of the load, in a constant amount per working stroke, characterized in that the number of skips is varied temporally infinitely and independently of the number of revolutions.

It is a further object of the invention to produce a process for intermittent control of a cyclically operating internal combustion engine wherein the number of skips is varied between about 5 to 7 times z and zero skips per actual working stroke, wherein z is the number of different working chambers of the internal combustion engine.

It is another object of the invention to distribute the skips temporally approximately uniformly over the various working chambers of the internal combustion engine.

It is another object of the invention to distribute the skips stochastically over the various working chambers.

It is yet another object of the invention that mechanical energy delivered by the internal combustion engine is intermediately stored in a manner compensating for torque surges and speed fluctuations prior to being transmitted to a load.

A further object of the invention resides in varying the temporal density of the working strokes with maximum sensitivity and independently of the number of revolutions of the crankshaft. Accordingly, it is readily possible in the power range close to idling for a working stroke not to be executed with each crankshaft revolution; rather, several crankshaft revolutions may be performed between the individual working strokes. It is possible, for example, to execute in the idling operation seven crankshaft revolutions, for instance, between each working stroke. With increasing power setting, the temporal spacing is correspondingly reduced, up to the condition wherein each cylinder performs a working stroke with each second crankshaft revolution (four-cycle engine) or with each crankshaft revolution (two-cycle engine).

These and other objects, features, and advantages of the present invention will become more apparent from the following description when taken in connection with the accompanying drawings which show, for the purposes of illustration only, different embodiments in accordance with the present invention, and wherein:

FIG. 1 shows a tabular overview of a staggered selection of thirteen firing patterns of a six-cylinder four-cycle engine, usable for executing the invention;

FIG. 6 shows the mutual arrangement of FIGS. 3–5 to form a combined diagram;

FIG. 7 shows another embodiment of the invention with ignition skips circulating without a pattern, with a stochastic triggering of injection.

In the drawings like reference numerals are used to designate like elements.

Before describing, in detail, the particular improved detecting apparatus in accordance with the present invention, it should be observed that the present invention resides primarily in the novel structural combination of conventional components and not in the particular detailed configurations thereof. Accordingly, the structure, control, and arrangements of these conventional components are illustrated in the figures of the drawings by readily understandable block representations in order not to obscure the disclosure with structural details which would be readily apparent to those skilled in the art having the benefit of the description herein. Thus, the block diagrams illustration of the figures of the drawings do not necessarily represent the mechanical structural arrangement of the exemplary system, but are primarily intended to illustrate the major structural components of this system in a convenient functional grouping so that the present invention can more readily be understood.

The embodiment of the invention associated with FIGS. 1–6 operates with a plurality of specific firing patterns staggered in dependence upon the load.

The tabular view of FIG. 1 shows a selection of thirteen patterns which are repeated after varying numbers of crankshaft revolutions. The left-hand column indicates for each pattern the average number of fired cylinders per camshaft revolution or per double revolution of the crankshaft. These figures, relevant for the power expended per revolution, demonstrate that the stepwise jumps in this selection of patterns, toward smaller power values, approach ten percent, but range higher at high power values. Due to the high working stroke density in the upper power range, though, patterns having finely staggered operating stroke density can be readily selected in this area, for example, a pattern wherein each eleventh working stroke is omitted; another wherein each tenth stroke is skipped; in the next pattern, every ninth working stroke is missing, and so forth. By extending the patterns over an even greater number of crankshaft revolutions, it is possible even in low-power ranges to obtain still finer staggering for the patterns. It is also possible to change over to an adjacent pattern even before completing one pattern and thus to realize mixed patterns. Thanks to these possibilities, power staggering can be attained which, under practical conditions, can no longer be distinguished from a continuous load adaptation.

Figure 2:
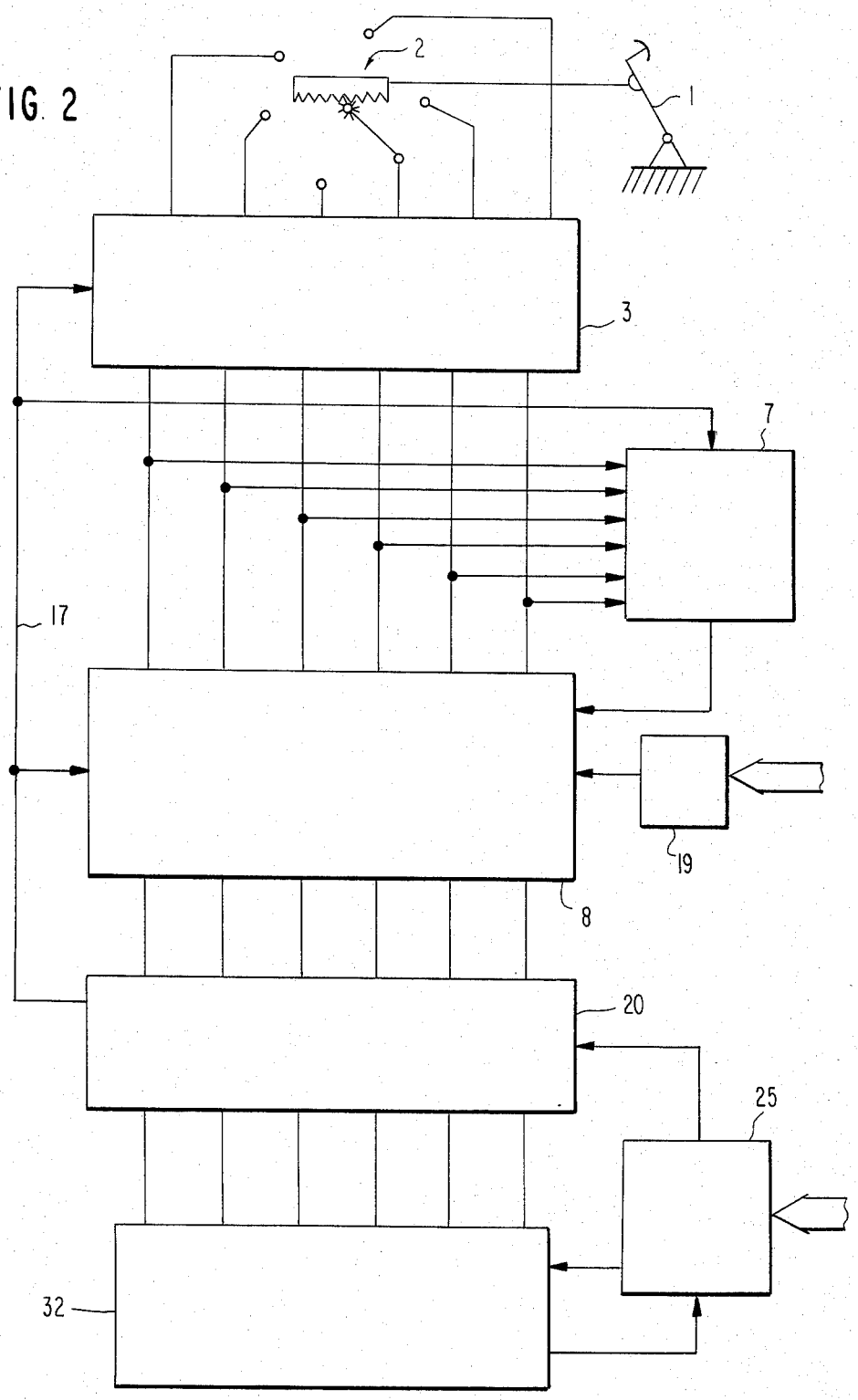
FIG. 2 is a block circuit diagram for a first embodiment of the invention of a six-cylinder engine with six load stages.

In order to realize the idea of differing firing patterns, FIG. 2 shows a gas pedal 1 coupled with an accelerator pedal switch 2 exhibiting the same number of switching contacts as firing patterns provided. The switching contacts of the accelerator pedal switch are connected to a load coding memory 3 storing, depending on the position of the accelerator pedal switch, the firing pattern corresponding to the acted-upon switching contact. The logic circuits illustrated in FIGS. 2–5 and can be realized, for example, discretely with commercial electronic components; a design with microprocessors would just as well be possible.

Such a microprocessor may be expected to have the usual computer architecture comprising at least an arithmetic unit capable of performing the four arithmetic functions, an input device by which the operating system and programming together with engine operating parameter data may be input. Such data will be stored in memory which will consist of a multiplicity of registers to store both operating system, programming and engine parameter data as well as data employed during calculation and operation. Programming may be effected in a higher level language such as FORTRAN, BASIC or PASCAL, however, characteristically, it may be performed in machine language or assembly language in order to achieve the well-known economy of maximum utilization of storage and high speed of operation.

Figure 3:
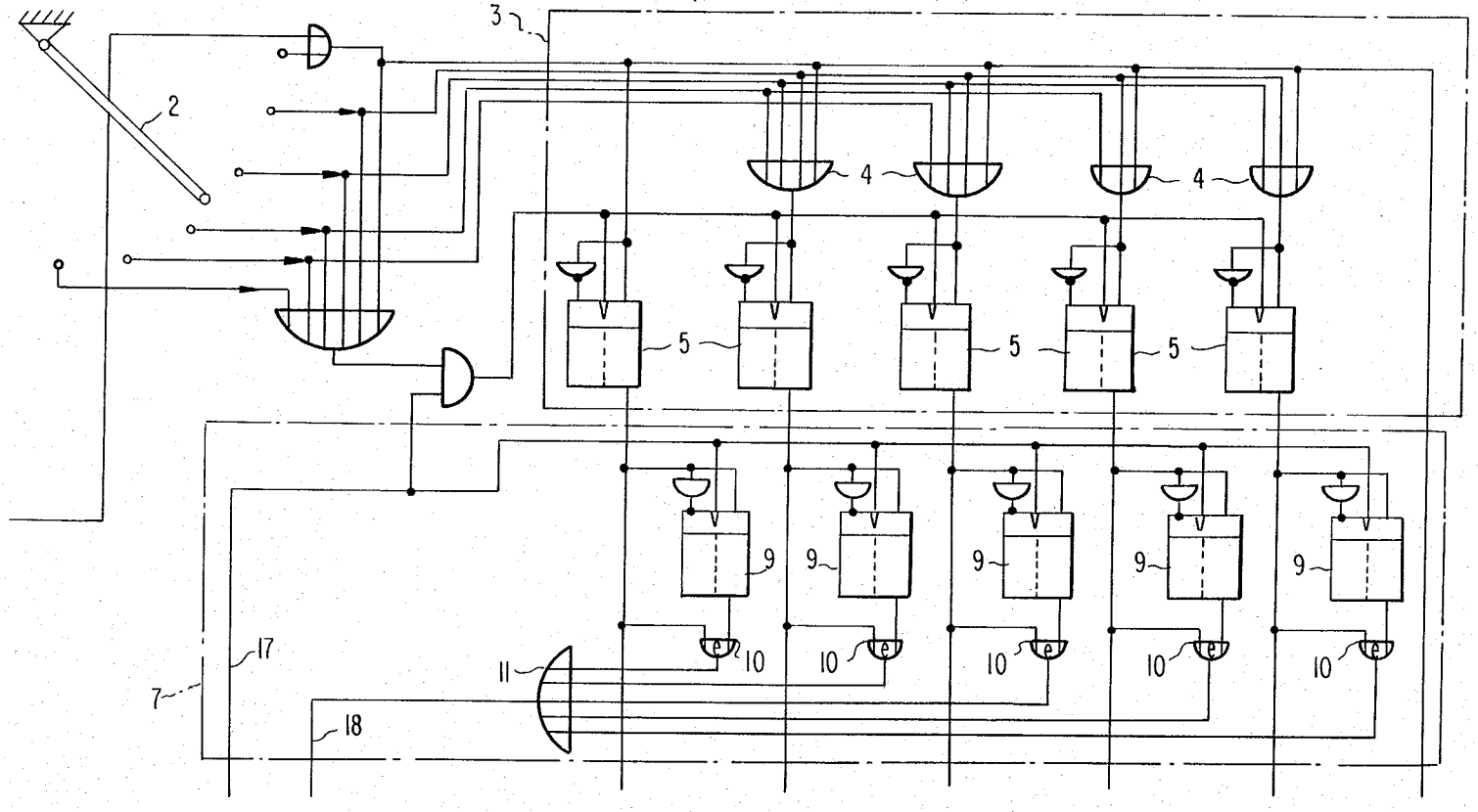
FIGS. 3–5 show a data flow chart of the embodiment of FIG. 2, distributed over three sheets and to be composed as shown in FIG. 6, but limited to six load stages.
Figure 4:
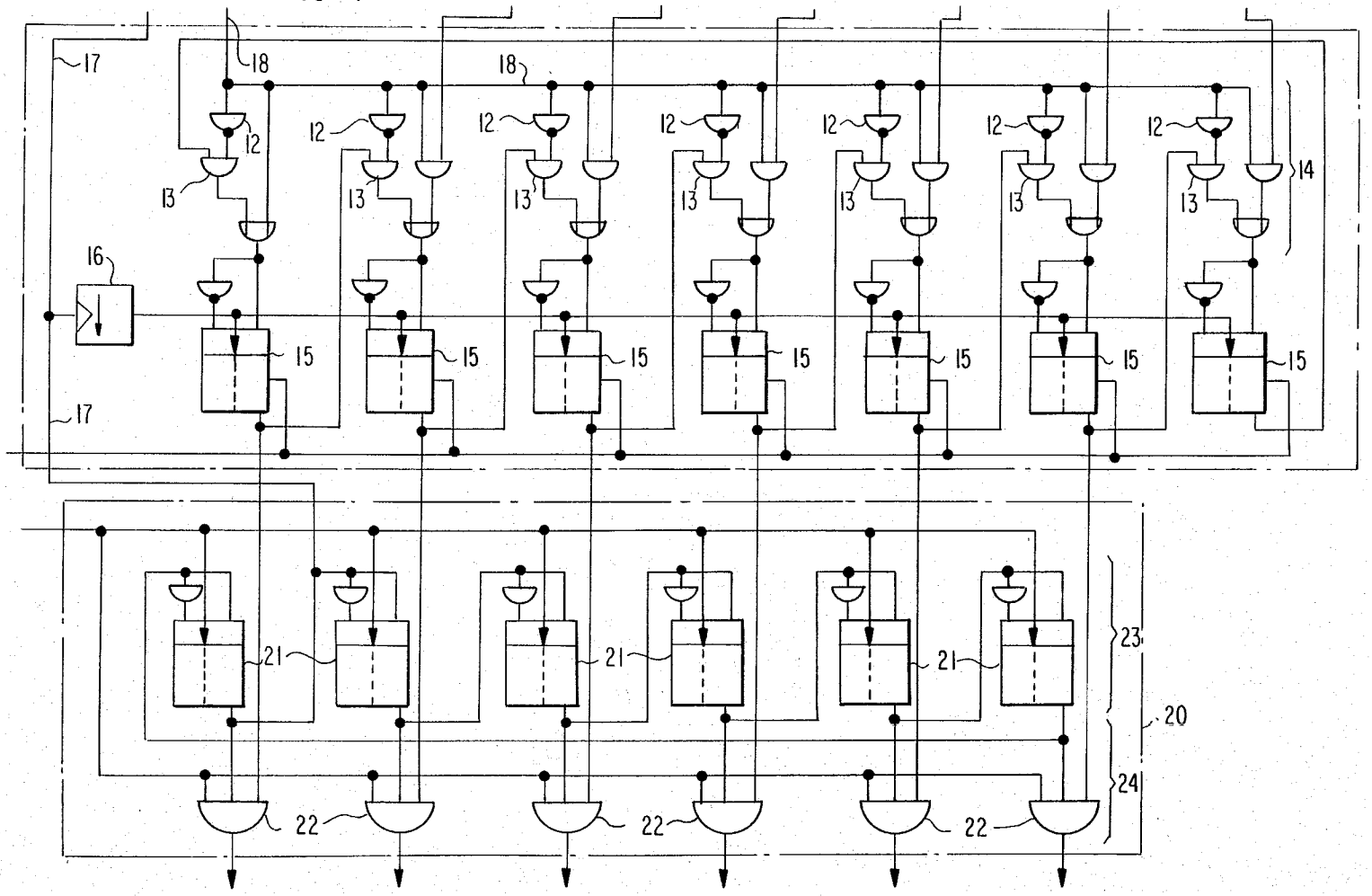
Figure 5:
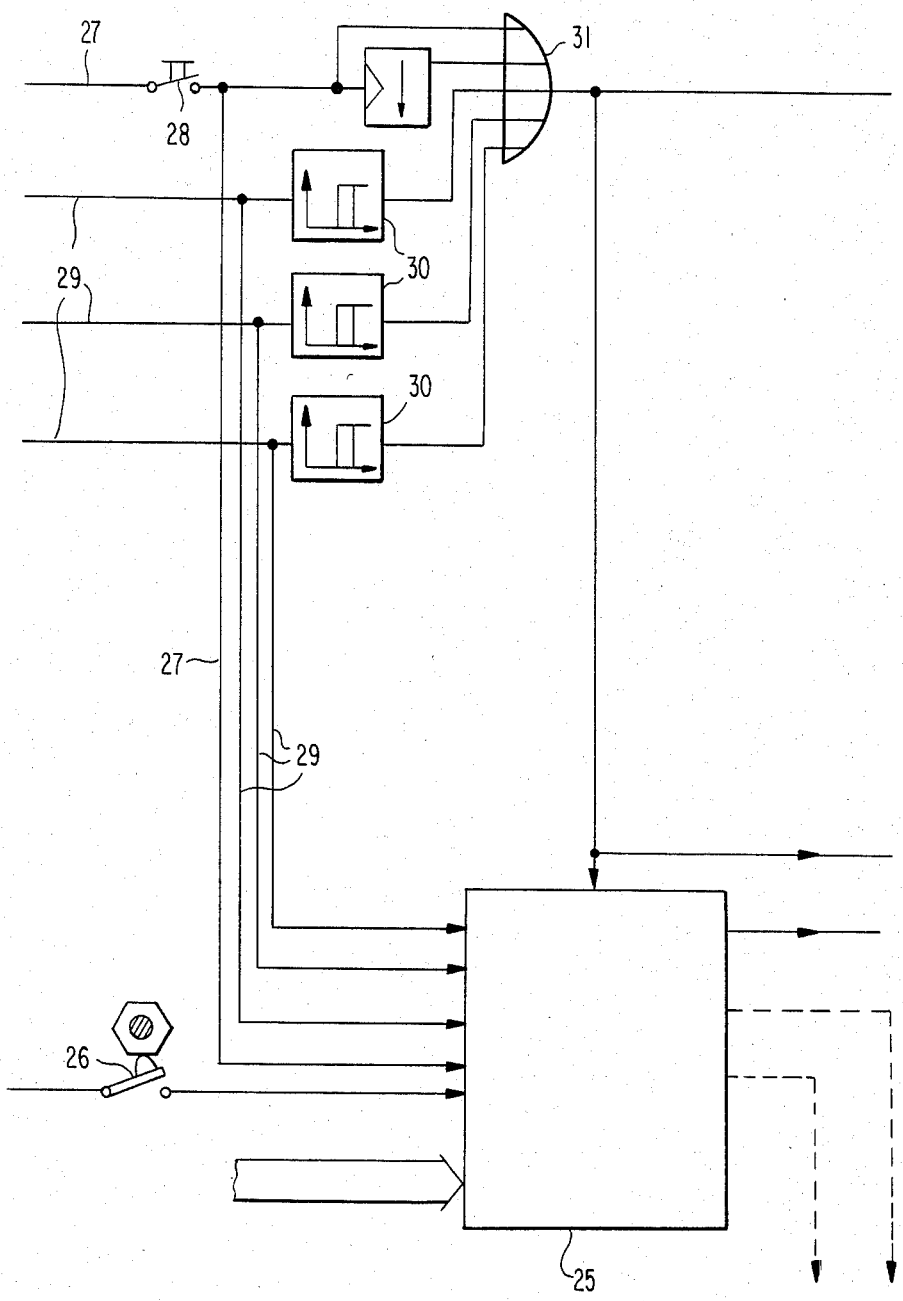

For purposes of simplification, the data flow chart shown in FIGS. 2–5 is demonstrated for only six load stages as shown in FIG. 3. The number of multivibrators, flip-flops 5, in the load coding memory is predetermined by the cylinder number of the internal combustion engine; however, since in the selected pattern design the cylinder first in ignition sequence is to be fired at the start in all patterns, one multivibrator less than the number of cylinders present can be provided. The writing in of the respective patterns has been accomplished in the illustrated embodiment by connecting the switching contacts of the accelerator pedal switch 2, by which a signal is input to many OR members 4 in the range of the higher load stages and to less OR members 4 in the low load range. Storage is effected by bistable multivibrators 5, connected at the output of the OR members 4 which can be activated cyclically together after each double revolution of the crankshaft using a control signal received via line 17 and AND gate 4*a*.

The outputs 51–56 of the load coding memory 3 are connected to a load stabilizer memory 7 as well as to a universal shift register 8. In the load stabilizer memory 7, the ignition patterns are likewise written into the bistable multivibrators 9, but these are the ignition patterns of the preceding engine cycle.

In the exclusive OR members 10 connected at the output of the multivibrators 9, the previous ignition signals and the new ignition signals are compared in each instance; the output of these OR members 10 yields a signal only if there is a change between the previous and the new ignition signals, i.e., if the load stage setting was changed. The outputs of all exclusive OR members 10 are connected jointly to an OR member 11 wherein it is determined whether any of the ignition signals has been altered; if so, then a signal appears at its output, shift signal line 18, if not so, no signal appears.

Respectively one inverting member 12 is arranged in each of the inputs of the subsequent universal shift register 17, this inverting member 12 transmitting a positive shift signal to the subsequent AND member 13 if no change took place in the ignition patterns from one engine cycle to the next. If the ignition patterns have changed, the shift signal is blocked by the inverting members 12. It would also be possible to arrange a joint inverting member following the OR member 11, or provide an inverting member integral with the latter.

The universal shift register 8, known per se in its structure, has seven stages as shown in exemplary form. Thus, the six basic ignition patterns producible by the load coding memory 3 can be shifted in correspondence with the X-ed lines in the table of FIG. 1. It would also be possible to accommodate additional stages in the shift register 8 which could be alternatively connectable or disconnectable; thereby, empty positions could be created or abolished, permitting a variation in the firing patterns. A peculiarity of the illustrated shift register 8 resides in that a signal input is associated with each stage and is connected via respectively a separate logic circuit 14 to a bistable multivibrator 15. A sequence of signals is written vertically into the shift register 15; in case of a timing signal transmitted via the monostable multivibrator 16 and in case of the signal "shift", this signal sequence is shifted horizontally through the stages of the shift register 15. The timing pulse for shifting the ignition signal sequence in the shift register 15 and for comparing previous and new ignition signal sequence is provided via the timing line 17 from the injection signal distributor 20. The shift register 8 can furthermore be set, by way of a starting-aid circuit 19, FIG. 2, on the basis of various influential variables, in such a way that, during starting and at least during part of the warm-up phase, full-cylinder operation is performed in any case. In such operation, the shift register stores signals representing the condition in which all cylinders operate.

During this time, the load adaptation must be carried out via air flow and/or fuel flow control, which can be triggered by the electronic controller 25 via throttle valve and/or injection quantity control as by lines 64 and 65, respectively. The starting time, instant of starting, of the internal combustion engine 32 as well as various measuring parameters, engine temperature, speed, and the like, relevant to starting and operation are transmitted to the electronic controller 25 by the lines 27 with ignition/starter switch 28, as well as by the lines 29 for the analog transmission of measuring parameters. Via hysteresis members 30, these measuring parameters are also connected to an OR member 31, the output of which via line 62 sets the multivibrators 15 of the universal shift register 8 constantly at "1" on the output side and thus ensures full-cylinder operation.

The injection signal distributor 20 comprises a series of bistable multivibrators 21 constituting a nonvolatile shift register 23 and deriving their timing from the injection pulses transmitted by the electronic controller 25 via line 63. The shift register 23 determines the fact of readiness of an individual cylinder for accepting a possible ignition signal in correspondence with the ignition sequence of the associated internal combustion engine 32. A cam-operated switch 26 yields a succession of pulses, the number of which per engine cycle corresponds to the cylinder number. These signals are processed into injection signals by the electronic controller, considering various parameters, such as gas pedal position, engine temperature, external atmospheric pressure, and external temperature, and are fed to the injection signal distributor. The nonvolatile shift register 23 is followed by a gating circuit 24 consisting of AND members 22.

Each of these members 22 is connected on the input side with a corresponding output of the universal shift register 8, which output yields the signal "injection" or, in case of skipping, no signal; furthermore, the members are connected with respectively one output of the stages of the shift register 23 for readiness association within the ignition sequence of the internal combustion engine. Finally, all AND members receive the injection pulse of the electronic controller 25 as a signal for an in-phase injection instant. A signal appears at the output of the members 22 only at that location, and only at that time, when all three inputs have a signal, whereby fuel injection is triggered at the corresponding cylinder in synchronism with the number of revolutions and in correspondence with the angle.

Controller 25 may take the form of one of many different configurations. The figure shows only a single exemplary form. It will be appreciated, therefore, that FIG. 8 in providing an example is in no manner limiting on the configuration which the controller may take, depending upon the desires of the artisan in practicing the invention. As shown in that figure, input starter switch 28, when closed, will present a voltage on line 27 which may serve to set a flip-flop 81. Characteristically, the voltage on line 27 may, of course, be the battery voltage. Flip-flop 81 thus assumes two stages, one representing the switch position in its open position and the second voltage, switch 28 in its closed position. The analog parameters, such as engine temperature, and the like, presented on lines 29 will, characteristically, be in the form of variable analog voltages each having a predetermined range of values. The voltages presented on lines 29 may be changed to digital signals in analog to digital converters 82, 83 and 84 and the results stored in respective registers 85, 86 and 87. By initial programming from the microprocessor input previously described, threshold values for such parameters may be stored in registers 88, 89 and 90. The microprocessor may perform a continuing comparison of each parameter with its respective threshold value in comparators 91, 92 and 93.

The cam operated switch 26 may also serve as an input to a flip-flop 94 to generate pulses presented as an output from 94.

Figure 8:
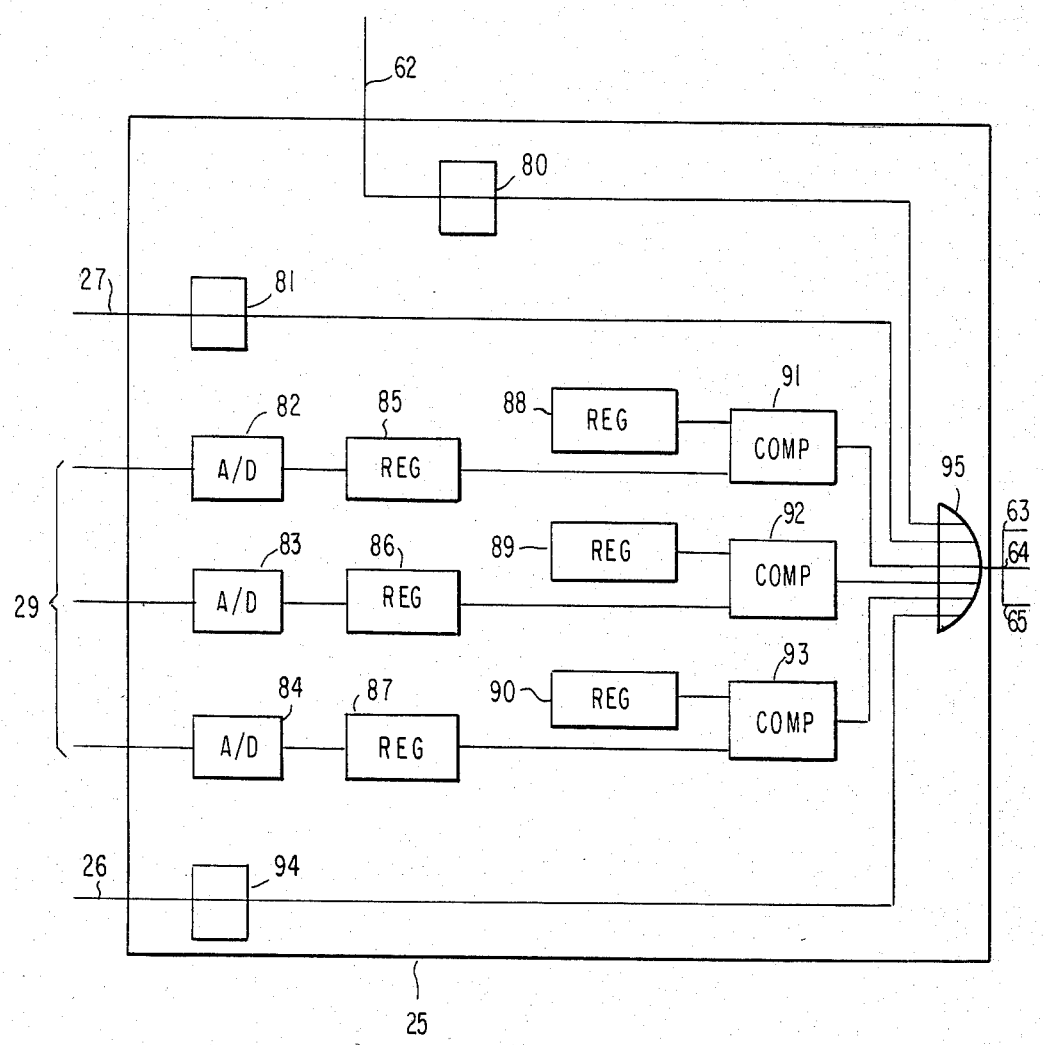
FIG. 8 shows an exemplary form of electronic controller.

By the same token, an input may be received on line 62 from OR circuit 31. By means of these respective inputs, the electronic controller may serve to produce an output signal when any of the signals are present by means of OR circuit 95, to produce an output for controlling the gating circuit 20 on line 63 and for controlling fuel input on lines 64 and 65. It will be appreciated, however, that other configurations may be effected so that the AND circuit 95 may be replaced by various combinations of AND and OR circuits for the purposes of satisfying a particular logical requirement as designated by the artisan and thus, the configuration shown in FIG. 8 is exemplary only.

While electronic controller 25 has been shown configured with an OR gate 95, the artisan will recognize that the frequency and timing of signals on output lines 63–65 may be varied by the use of a different logic configuration in lieu of or in addition to OR gate 95. For example, employing an AND gate in lieu or in addition to OR gate 95, with, for example, a parameter signal from comparator 93 and an output signal from flip-flop 94 as the inputs to the AND gate, the frequency of the signals on lines 63–65 can be varied inasmuch as the output signal on these lines would then be produced only dependent upon the simultaneous presentation of signals from comparator 93 and line 26.

Alternatively, the practitioner of the invention, if desired, may configure the logic so that the signals output on the individual output lines 63, 64 and 65 may have different frequencies and different timing. For example, an AND gate receiving inputs from flip-flops 80 and 81 may produce an output which is directed solely to output 63, for example, while the OR gate produces an output for line 64 and, in addition, if desired, some other configuration of AND and OR gates may produce the output for line 65.

It will be thus apparent from the foregoing description of the electronic controller 25 that great flexibility may be provided to produce the output signals desired.

A feature of the embodiment according to FIGS. 1–6 resides in that each load stage is associated with a specific firing pattern, and that these patterns, with constant load application control, are shifted through the cylinder series of the internal combustion engine after each engine cycle by one ignition timing step or, in a correspondingly modified version, by several ignition timing steps. In the example, the firing patterns in the table of FIG. 1 marked with an X are designed so that the ignition signal sequence of a specific load stage is formed within the first column, first engine cycle, by shifting by one cylinder and transfer into the next column, subsequent engine cycle. This makes it possible, on the one hand, to fire all cylinders to an approximately uniformly great extent, even with a very low working stroke density, and thus stress all cylinders thermally to an approximately equal degree. On the other hand, by the shifting process, the firing patterns extending over several engine cycles can be automatically formed from a specific ignition signal sequence within the first engine cycle of the instantly governing firing pattern, due to a varied continued input of this ignition signal sequence into the following engine cycles.

A certain disadvantage of this embodiment resides in that the firing patterns unavoidably are accompanied by a certain periodicity which can enter into reasonance with the crankshaft revolution. For this reason, an embodiment is to be described below, in addition to the above, with a skip control operated without a pattern, as illustrated in FIG. 7.

The internal combustion engine 32 is associated with an electronic controller 25', which may be similar to that of the embodiment shown in FIGS. 2–6. The controller 25' receives a timing signal from the internal combustion engine 32 on line 26' which may, for example, be derived from the camshaft, and transmits a timing signal on line 33' to an injection signal distributor 33, this signal containing, per engine cycle, a number of pulses corresponding to the cylinder number, the pulses being arranged therein in a mutual chronological spacing corresponding to the ignition timing step spacing of the internal combustion engine.

The pulses can be made to lead the instant of ignition by a certain crank angle, taking various operating parameters into account. The injection signal distributor 33 is designed essentially as a six-stage shift register which cyclically processes the pulses of the timing signal in accordance with the ignition sequence of the internal combustion engine through the series of outputs of the shaft register in synchronism with the number of revolutions and in accordance with the angle. A gating circuit 35 consisting of six AND members is connected after the shift register 33; the individual outputs of this gating circuit 35 are connected at least indirectly to respectively one solenoid valve 34 for fuel injection. The fuel can be fed, for example, via a controllable fuel feed pump 36, driven by the internal combustion engine, from a fuel tank 37 by way of an accumulator or pressure storage means 38 to the solenoid valves 34 and, via the latter, to the injection nozzles, not shown. The accumulator 38 is coupled with the flow control of the fuel feed pump 36 in such a way that, speed variations of the fuel feed pump 36 notwithstanding, the conveying pressure of this feed pump 36 has a constant level in the fuel.

A random number generator 39 is provided for the load-dependent skip control free of any pattern; this random number generator produces, in time with the above-mentioned pulses, random numbers of between 1 and $2^n-1$, wherein n is an integer, if at all possible, above 4, for example 5; accordingly, the random generator 39, in stochastic distribution, would dispense in a timed operation, numbers of between one and thirty-one. Random numbers generators are well known in the art and the details as to circuitry and programming, per se, do not form part of this invention. Furthermore, an angle generator 40 coupled with the gas pedal 1 is provided, generating an electrical analog signal corresponding to the angle of the gas pedal 1; this signal is converted into a corresponding numerical value by way of an analog-to-digital converter 41 connected at the output of the angle generator.

It is important, in this connection, that the number of bits of this converter 41 coincides with the number n from the random number generator 38, i.e., that the entire measuring range of the angle generator is likewise divided, by the A/D converter, into $2^n$, for example, into thirty-two stages from 0 to 31. A digital load signal corresponding to the load introduced at the gas pedal 1 appears at the output of the A/D converter 41. The outputs of the A/D converter 41 and of the random number generator 39 are connected to a comparator memory 42. The latter compares the digital load signal from A/D converter 41 with the random number dispensed by the generator 39 and, in case the random number is equal to or smaller than the number corresponding to the digital load signal, produces a positive signal at its output; otherwise, this output yields a "zero". The higher the digital load signal, the greater the probability that respectively a positive signal is produced at the output of the comparator memory 42 after each pulse of the timing signal; the lower the digital load signal, the smaller the probability.

The output of the comparator memory 42 is connected on the input side to the AND members of the gating circuit 35. The outputs at the AND members are positive with a degree of probability which is the greater, the higher the introduced load; and vice versa.

The internal combustion engine 32 or the crankshaft, thereof is equipped with a very sturdily dimensioned flywheel 43 serving as the intermediate storage means for the drive energy over several engine cycles, in a manner compensating for the fluctuations in the number of revolutions. This is important, in particular, in case of a low load introduction with a low working stroke density. For the sake of completing the disclosure, it should be noted that the skip control according to this invention is also applicable to internal combustion engines having a low number of cylinders, for example, two or three cylinders; a possible degree of nonuniformity of the engine operation would have to be compensated for by a correspondingly sturdy dimensioning of the flywheel and a soft engine suspension.

While we have shown and described only two embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A process for intermittent control of a cyclically operating internal combustion engine having plural working chambers, the steps comprising:

skipping working strokes in the succession of working cycles;

distributing the skipped working strokes stochastically among the various working chambers;

distributing the skipped working strokes approximately uniformly in time;

varying the number of skipped working strokes in dependence on the load and independently of the number of revolutions; and feeding fuel in a controlled fashion only respectively to the nonskipped working chambers of the internal combustion engine independently of the load in a constant amount per working stroke.

2. A process according to claim 1, wherein the skips are distributed temporally approximately uniformly among the working chambers of the internal combustion engine.

3. A process for intermittent control of a cyclically operating internal combustion engine having plural working chambers, the steps comprising:

skipping working strokes in the succession of working cycles;

distributing the skipped working strokes approximately uniformly in time;

varying the number of skipped working strokes in dependence on the load and independently of the number of revolutions;

feeding fuel in a controlled fashion only respectively to the nonskipped working chambers of the internal combustion engine independently of the load in a constant amount per working stroke, and varying the number of skipped working strokes between 0 skips per actual working stroke and about five to seven times z, where z is the number of different working chambers of the internal combustion engine, and distributing the skips stochastically among the various working chambers.

4. A process according to one of claim 1, further comprising the step of storing intermediately the mechanical energy delivered by the internal combustion engine in a manner compensating for torque surges and speed fluctuations prior to being transmitted to a load.

* * * * *